US007984541B1

(12) United States Patent
Davidson

(10) Patent No.: US 7,984,541 B1
(45) Date of Patent: Jul. 26, 2011

(54) ANCHOR BOLT SUPPORTING TEMPLATE FOR A CONCRETE MOLD AND MOLD ASSEMBLY AND METHOD OF ASSEMBLING ANCHOR BOLTS WITH A MOLD

(75) Inventor: James T. Davidson, Oklahoma City, OK (US)

(73) Assignee: James Davidson Trust Dated January 4, 2005, Oklahoma City, OK (US)

( * ) Notice: Subject to any disclaimer, the term of this patent is extended or adjusted under 35 U.S.C. 154(b) by 1337 days.

(21) Appl. No.: 10/908,569

(22) Filed: May 17, 2005

(51) Int. Cl.
*E04G 21/12* (2006.01)
*E04G 17/00* (2006.01)
*B25B 27/14* (2006.01)

(52) U.S. Cl. ..... 29/469; 29/281.6; 264/35; 52/741.15; 52/745.21; 249/51; 249/93; 33/644; 33/645

(58) Field of Classification Search ..... 249/34, 249/91, 93, 48, 49, 51; 33/518, 613, 644, 33/645; 52/295, 741.15, 745.21; 29/469, 29/281.6; 264/35
See application file for complete search history.

(56) References Cited

U.S. PATENT DOCUMENTS 681,551 A * 8/1901 Hulse et al. ..... 33/525
871,879 A * 11/1907 Middleton ..... 249/91
2,378,850 A * 6/1945 Hyre ..... 249/34
2,760,272 A * 8/1956 Van Cantie ..... 33/518
3,025,608 A * 3/1962 Hendrix ..... 33/668
3,204,493 A * 9/1965 Severdia ..... 33/645
3,219,308 A * 11/1965 Halstead ..... 33/613
3,458,184 A 7/1969 Schlosser
3,516,753 A * 6/1970 Dickey ..... 264/275
3,759,478 A * 9/1973 Schmitt et al. ..... 249/93
3,799,492 A * 3/1974 O'Laughlin ..... 249/51
3,912,218 A 10/1975 Lister
3,960,356 A * 6/1976 Adams ..... 249/93
4,000,591 A 1/1977 Courtois
4,009,550 A * 3/1977 Young ..... 249/93
4,164,076 A * 8/1979 Carrigan ..... 33/644
(Continued)

FOREIGN PATENT DOCUMENTS

JP 2164931 6/1990

OTHER PUBLICATIONS

Abstract of patent JP2164931.

*Primary Examiner* — Michael Safavi
(74) *Attorney, Agent, or Firm* — Mary M. Lee

(57) ABSTRACT

An anchor bolt template for use with cardboard molds used to form concrete into footings and other foundations. The template is integrally formed of plastic or some other resilient, light weight material. The most common bolt configuration includes four bolts spaced equal distances from the foundation's center. Thus, the preferred template shape is four arms extending radially from a hub. Each of the arms has bolt location markers labeled with the diameters of several bolt patterns. The arms may be generally C-shaped in cross section so that the depending edges ride on the upper edge of the mold, supporting the lower anchor bolt nut above the concrete. Notches, preferably labeled by mold size, on the bottom of the depending edges of the arms receive the upper edge of the mold so that as heavy concrete is poured into the cardboard mold the sidewall of the mold will not deform.

23 Claims, 2 Drawing Sheets

U.S. PATENT DOCUMENTS

| | | | | | |
|---|---|---|---|---|---|
| 4,521,969 | A | * | 6/1985 | Greenwood | 33/645 |
| 4,671,483 | A | * | 6/1987 | Harbeke | 249/91 |
| 4,676,005 | A | * | 6/1987 | Seligman | 33/613 |
| 4,736,554 | A | | 4/1988 | Tyler | |
| 5,056,966 | A | * | 10/1991 | Lee | 408/115 R |
| 5,060,436 | A | | 10/1991 | Delgado, Jr. | |
| 5,240,224 | A | | 8/1993 | Adams | |
| 5,367,783 | A | * | 11/1994 | Nygren | 33/613 |
| 5,505,033 | A | | 4/1996 | Matsuo et al. | |
| 5,630,303 | A | | 5/1997 | Devenish, III | |
| 5,670,076 | A | * | 9/1997 | Leek | 249/91 |
| 5,688,428 | A | * | 11/1997 | Maguire | 249/91 |
| 5,836,132 | A | | 11/1998 | Weathersby | |
| 6,077,000 | A | * | 6/2000 | Gibbons et al. | 33/613 |
| 6,431,517 | B1 | * | 8/2002 | Chapman | 249/93 |
| 6,643,945 | B1 | | 11/2003 | Starks | |
| 6,666,441 | B2 | | 12/2003 | Grendahl | |
| 7,155,875 | B2 | * | 1/2007 | Henderson | 52/741.15 |
| 2004/0040224 | A1 | * | 3/2004 | Dayton | 52/295 |
| 2006/0016140 | A1 | * | 1/2006 | Smith | 52/295 |

* cited by examiner

ANCHOR BOLT SUPPORTING TEMPLATE FOR A CONCRETE MOLD AND MOLD ASSEMBLY AND METHOD OF ASSEMBLING ANCHOR BOLTS WITH A MOLD

FIELD OF THE INVENTION

The present invention relates generally to devices for supporting anchor bolts in concrete and, more particularly but without limitation, to templates for supporting such bolts in a cardboard mold while the concrete inside hardens.

BACKGROUND OF THE INVENTION

Poles that support traffic signals, parking lot lights, street lights, and other traffic and lighting fixtures usually are mounted on top of a subsurface concrete footing. The base of the pole is attached to the footing by means of anchor bolts embedded in the footing. The number, size and configuration of these anchor bolts are standardized, and the pole bases are constructed in accordance with these standards. Thus, correct positioning of the anchor bolts during formation of the footings is important to later installation of the poles. The present invention addresses this need with a preformed plastic template that can be used to support the anchor bolts within the mold in a selected arrangement while the concrete is poured and allowed to set. While the bolt supporting template of this invention is particularly useful in the placement of concrete footings for poles supporting traffic and lighting fixtures, other applications will be readily apparent.

SUMMARY OF THE INVENTION

The present invention comprises an anchor bolt template used to support a plurality of anchor bolts in at least a first pattern inside a concrete mold. The mold comprises a side wall terminating at an open top having a diameter and defined by an upper edge. The template comprises an integrally formed body sized for placement over the open top of the mold, the body having an upper surface and a lower surface. At least a first set of notches is formed on the lower surface of the body. The notches are positioned at circumferentially spaced points corresponding to points on the upper edge of the mold. The notches are sized to receive the upper edge of the mold so that, when the template is fitted on the open top of the mold and as concrete is poured into the mold, the side walls of the mold resist deformation by the concrete. At least a first set of bolt locator indicia is provided on the body, the first set of indicia representative of bolt locations arranged in a first bolt pattern.

Further, the present invention comprises an anchor bolt template to support a plurality of anchor bolts in at least a first pattern inside a concrete mold. The mold comprises a side wall terminating at an open top having a diameter and defined by an upper edge. Each of the anchor bolts comprises a first nut and a second nut for engaging the template therebetween. The template comprises an integrally formed body sized for placement over the open top of the mold, the body having an upper surface and a lower surface. At least a first set of bolt locator indicia is provide on the upper surface of the body, the first set of indicia representative of bolt locations arranged in a first bolt pattern. Thus, when the anchor bolts are inserted through the template at the bolt locations, the first nut will engage the upper surface of the template and the second nut will engage the lower surface of the template. A spacer is included on the lower surface of the body. The spacer is sized and positioned to support the lower surface of the body a distance from the upper edge of the mold, the distance being at least about the width of the second nut.

DETAILED DESCRIPTION OF THE PREFERRED EMBODIMENT

Figure 1:
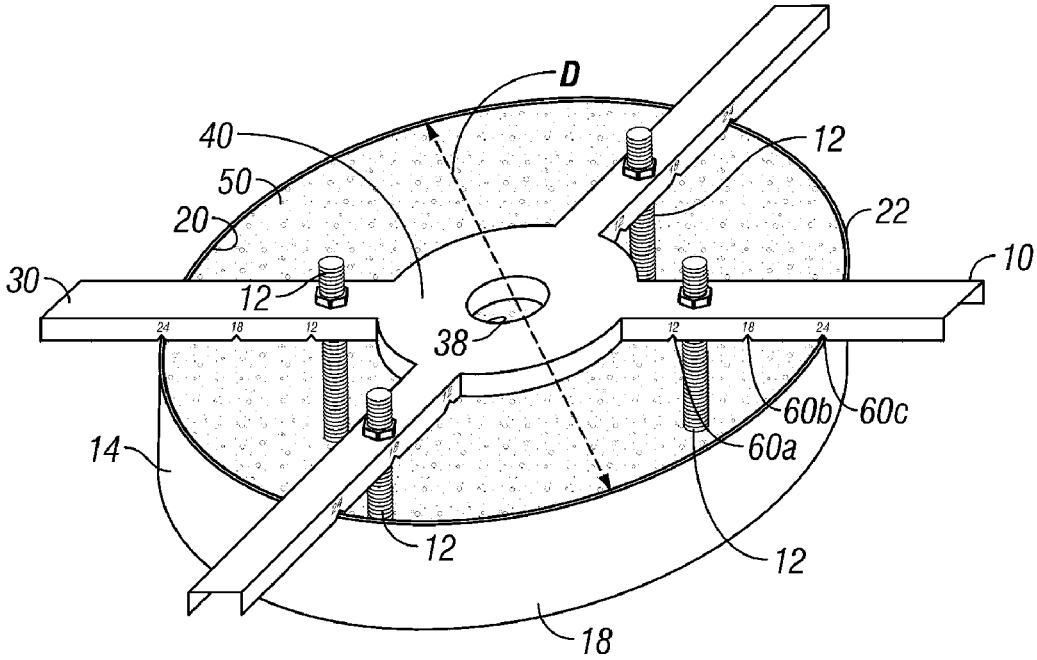
FIG. 1 is a perspective view of the anchor bolt template of the present invention shown positioned over a cylindrical mold and supporting four anchor bolts therein in a standard formation.

Turning now to the drawings in general and to FIG. 1 in particular, there is shown therein a bolt supporting template constructed in accordance with the present invention and designated generally by the reference numeral 10. The template 10 is designed to support a plurality of anchor bolts, designated collectively at 12, in at least a first pattern inside a concrete mold 14.

The mold 14 typically is a commercially available cardboard mold form. While the mold is usually cylindrical, it will be apparent that the template 10 as shown will accommodate other mold shapes, such as square. In addition, the shape of the template 10 may be modified to suit other shapes of molds. Generally, the mold 14 has a side wall 18 terminating at an open top 20 defined by an upper edge 22 and having diameter indicated at "D.".

Figure 2:
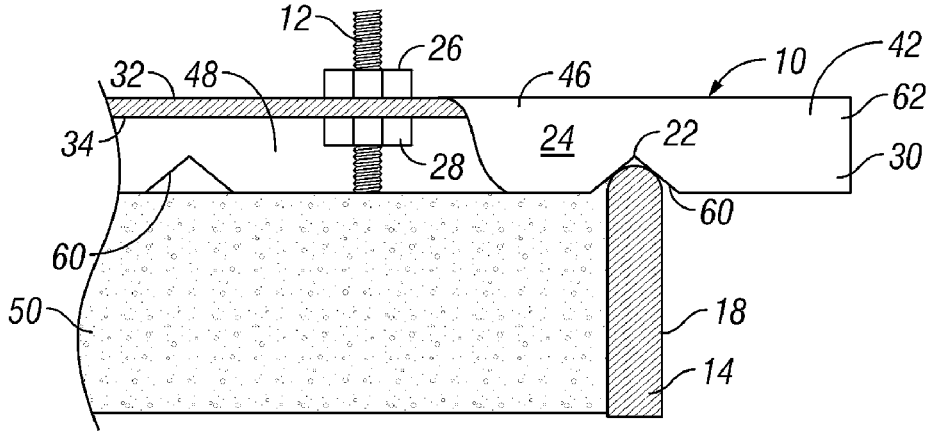
FIG. 2 is a fragmented, partially sectional side elevation view of one of the arms of the anchor bolt template of FIG. 1.

Referring now to FIG. 2, the anchor bolts 12 each will comprise at least a first nut 26 for supporting the bolt on the template 10. More preferably, each bolt 12 further comprises a second nut 28 for engaging the template 10 therebetween. See also FIG. 4.

With continuing reference to FIGS. 1 and 2, the template 10 preferably comprises an integrally formed body 30 sized for placement over the open top 20 of the mold 14. The body 30 has an upper surface 32 and a lower surface 34. Now it will be seen that the first nut 26 engages the upper surface 32 and the second nut 28 engages the lower surface 34.

Figure 3:
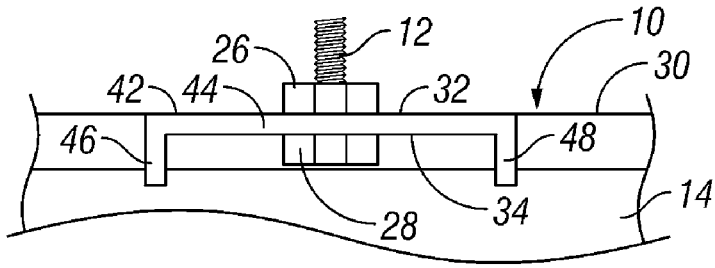
FIG. 3 is a fragmented view of the template shown in FIG. 1 showing the end of the arm positioned over the edge of the mold.

While the configuration of the body 30 may vary, a preferred form comprises a center or hub 40 and a plurality or arms 42 extending radially from the hub. The center of the hub 40 usually will be formed with an opening 38 therethrough to receiving wiring typically contained in a center bore (not shown) in the concrete footing. The arms 42 may have various shapes, but a preferred configuration is generally C-shaped, that is a flat central spine 44 with opposing edges 46 and 48 depending therefrom. The length of the edges 46 and 48 should be at least about the same as the width of the second nuts 28, as shown in FIGS. 2 and 3. This allows the edges 46 and 48 to serve as a spacer sized and positioned to support the lower surface 34 of the body 30 a distance from the upper edge 22 of the mold 14. Now it will be understood that this spacer—the edges 46 and 48—causes the bottom or second nut 28 to remain above the level of the concrete 50 when the mold 14 is filled.

Figure 4:
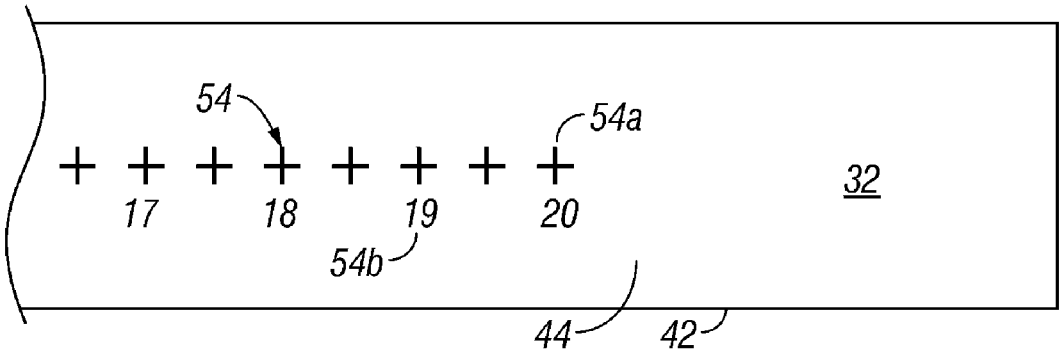
FIG. 4 is an enlarged, fragmented plan view of one of the arms of the template illustrating the drill starts and the indicia indicating the diameter of the bolt patterns.

As previously stated, the bolt configurations are standardized. Most commonly, there are 4 bolts arranged in a circle equal distances apart. The diameter of this circular pattern, however, varies from job to job, typically being 20 inches or less. To facilitate the proper placement of the bolt holes in the template 10, at least a first set of bolt locator indicia, indicated generally at 54, is provided on the body 30 of the template 10, as seen in FIG. 4 to which attention now is directed. Where the template 10 is formed as shown herein with four radially extending arms 42 (only one of which is seen in FIG. 4), the indicia 54 conveniently is placed on the upper surface 32 of each arm.

The bolt indicia 54 may comprise notches, cross or hash marks, or other surface interruptions which, in addition to indicating a selected position, may also serve as drill starts. Alternately, the bolt indicia 54 may comprise number or lettering. More preferably, the indicia 54 comprises a combination of notches or dimples that serve as drill starts and numbers indicating the diameter of the bolt pattern in inches. For example, each arm 42 preferably is marked with dimples or hash marks at half inch intervals and numbers, such as "20," "19," "18," and so forth, at each inch interval, as illustrated in the enlarged view of the arm 42 in FIG. 4.

Even more preferably, a plurality of sets of bolt locator indicia 54 is provided on the arms 42. For example, the bolt locator indicia 54 could comprise a first set of indicia 54*a* representative of bolt locations arranged in a first bolt pattern with the bolts positioned in a 20 inch circular pattern and a second set of indicia 54*b* representative of bolt locations arranged in a second bolt pattern at 19 inches. Now it will be apparent that many sets of indicia 54 corresponding to a large number of patterns could be included on the template 10.

As indicated previously, the molds used to form the concrete for the footings typically are formed of cardboard. While lightweight and inexpensive, this material may deform as the concrete 50 is poured, resulting in a misshapen footing. The present invention addresses this problem. While supporting the bolts 12 in a desired pattern while the concrete 50 is poured and sets, the template 10 of the present invention can also provide additional support for the sidewalls 18 of the mold 14. To this end, notches, designated generally at 60, may be formed on the lower surface 34 of the body 30, more particularly, on the lowermost aspect of the edges 46 and 48, as seen in FIGS. 1 and 2.

For example, at least a first set of notches 60*a* may be positioned at circumferentially spaced points corresponding to points on the upper edge 22 of the mold 14 with which template 10 will be used. It will be noted that, where notches 60 are to be provided in the edges 46 and 48, the length of the edges should be extended so as to be slightly greater than the width of the second nuts 28 to offset the depth of the notches.

The cardboard molds 14 are available in a range of standard sizes or diameters indicated at "D" in FIG. 1, including 12, 18 and 24 inches. Accordingly, the first set of notches 60*a* may be positioned and sized to receive the edge 22 of a 24-inch diameter mold cylinder. In this way, when the template 10 is fitted on the open top 20 of the mold 14 and as concrete 50 is poured into the mold, the side wall 18 of the mold will resist deformation under the weight of the concrete.

Now it will be seen that the template 10 advantageously may be adapted for use with several sizes of molds, each size having a different diameter "D." Thus, the notches 60 may further include a second set of notches 60*b*, the notches 60*a* and 60*b* positioned to receive two different diameters of molds. Even more desirably, the template 10 may include a third set of notches 60*c*. Thus, the one template 10 is useable with 12-inch, 18-inch and 24-inch diameter molds.

As used herein, "notch" refers to any of a wide range of shapes and sizes of recesses, such as grooves, channels and the like, whether arranged circumferentially or radially, which are adapted to engage the edge of the mold 14. The specific configurations of the notches 60 will vary depending on the configuration of the template 10 as well as the style of mold 14 with which it is intended to be used.

The template 10 may comprise mold size indicia 62 relative to the notches 60, the size indicia representative of the diameter of the corresponding mold diameter "D," as seen best in FIG. 2. Ideally, these size indicia may be provided on the sides of the arms 42, such as on one or both of the edges 46 and 48.

The template may be manufactured by several means. Preferred fabrication methods include injection and vacuum molding. The material may vary, but plastic is preferred. The material should be slightly resilient, light weight and waterproof. A particular preferred material is ultraviolet-stabilized plastic.

The use of the template 10 is apparent from the forgoing description and, therefore, will only be summarized briefly. First, the site for the footing is selected, and the earth is excavated to form a hole of sufficient size to receive a selected mold 14. Next, the mold is positioned in the hole in a conventional manner. Once the mold is positioned, the selected group of notches 60—12-inch, 18-inch or 24-inch—are pressed on the upper edge 22 of the mold 14, thereby holding the mold in its intended shape. Wires, if any, are pulled up through the empty mold 14 and fed through the opening 38. Bolt holes are drilled through the arms 42 of the template 10, according to the predetermined bolt pattern. Next, the bolts 12 are positioned in the arms 42 and secured with the first and second nuts 26 and 28. With the bolts 12 properly suspended over the empty mold 14, and the edge 22 of the mold supported in its desired shape, concrete 50 is poured into the mold to the desired level. Because the second nuts 28 are supported just above the upper edge 22 of the mold 14, the nuts are not embedded in the concrete 50. Once the concrete 50 has set, the upper nuts 26 are removed and the template 10 is lifted offer. Finally, the mold 14 is removed and the surrounding area is back filled with earth in the usual manner.

Changes can be made in the combination and arrangement of the various parts and elements described herein without departing from the spirit and scope of the invention as defined in the following claims.

What is claimed is:

1. A method for supporting a plurality of anchor bolts in at least a first pattern in wet concrete to form a concrete footing, wherein each of the anchor bolts comprises a first nut and a second nut for engaging the template therebetween, the method comprising:

providing at least one concrete mold, each concrete mold comprising a side wall terminating at an open top having a diameter and defined by an upper edge;

providing an anchor bolt template comprising:

an integrally formed body sized for placement over the open top of the mold, the body having an upper surface and a lower surface;

at least a first set of bolt locator indicia on the upper surface of the body, the first set of indicia representative of bolt locations arranged in a first bolt pattern, whereby, when the anchor bolts are inserted through the template at the bolt locations, the first nut will engage the upper surface of the template and the second nut will engage the lower surface of the template;

a spacer on the lower surface of the body sized and positioned to support the lower surface of the body a distance from the upper edge of the mold, the distance being at least about the width of the second nut; and attaching the anchor bolts to the template using the first and second nuts; and positioning the template on the upper edge of the mold.

2. The method of claim 1 wherein the body of the template is formed by a hub and a plurality of arms extending radially from the hub.

3. The method of claim 2 wherein the at least one concrete mold comprises a plurality of concrete molds each having a different diameter, wherein the template is adapted for use with a plurality of different mold diameters, wherein the at least one set of bolt locator indicia comprises a first set and a second set of bolt locator indicia, wherein the second set of bolt locator indicia set corresponds to a second bolt pattern, and wherein the method further comprises selecting one of the plurality of molds and selecting the first or second set of bolt locator indicia sized for the selected mold.

4. The method of claim 3 wherein the template further comprises size indicia relative to the bolt locator indicia representative of the diameter of the first and second bolt patterns.

5. The method of claim 1 wherein the body of the template is formed by a hub and a plurality of arms extending radially from the hub, and wherein each arm is generally C-shaped forming a spine with opposing depending edges so that the pair of depending edges form the spacer, and wherein the template positioning step comprises placing the template over the mold so that the depending edges of the template contact the upper edge of the mold.

6. The method of claim 1 wherein the template further comprises size indicia relative to the bolt locator indicia representative of the diameter of the first bolt pattern.

7. An assembly for supporting a plurality of anchor bolts in concrete in at least a first pattern, wherein each of the anchor bolts comprises a first nut and a second nut for engaging the template therebetween, the assembly comprising:

at least one concrete mold comprising a side wall terminating at an open top having a diameter and defined by an upper edge; and a template comprising:

an integrally formed body sized for placement over the open top of the mold, the body having an upper surface and a lower surface;

at least a first set of bolt locator indicia on the upper surface of the body, the first set of indicia representative of bolt locations arranged in a first bolt pattern, whereby, when the anchor bolts are inserted through the template at the bolt locations, the first nut will engage the upper surface of the template and the second nut will engage the lower surface of the template;

a spacer on the lower surface of the body sized and positioned to support the lower surface of the body a distance from the upper edge of the mold, the distance being at least about the width of the second nut.

8. The assembly of claim 7 wherein the body of the template is formed by a hub and a plurality of arms extending radially from the hub.

9. The assembly of claim 8 wherein the at least one concrete mold comprises a plurality of concrete molds each having a different diameter, wherein the template is adapted for use with a plurality of mold sizes, each size having a different diameter, wherein the at least one set of bolt locator indicia comprises a first set and a second set of bolt locator indicia, and wherein the second set of bolt locator indicia set corresponds to a second bolt pattern.

10. The assembly of claim 9 wherein the template further comprises size indicia relative to the bolt locator indicia representative of the diameter of the first and second bolt patterns.

11. The assembly of claim 7 wherein the body of the template is formed by a hub and a plurality of arms extending radially from the hub, and wherein each arm is generally C-shaped forming a spine with opposing depending edges so that the pair of depending edges form the spacer.

12. The assembly of claim 7 wherein the template further comprises size indicia relative to the bolt locator indicia representative of the diameter of the first bolt pattern.

13. An anchor bolt template to support a plurality of anchor bolts in at least a first pattern inside a concrete mold, the mold comprising a side wall terminating at an open top having a diameter and defined by an upper edge, the template comprising:

an integrally formed body sized for placement over the open top of the mold, the body having an upper surface and a lower surface;

at least a first set of notches formed on the lower surface of the body, wherein the notches are positioned at circumferentially spaced points corresponding to points on the upper edge of the mold, and wherein the notches are sized to receive the upper edge of the mold so that when the template is fitted on the open top of the mold and as concrete is poured into the mold, the side walls of the mold resist deformation by the concrete;

at least a first set of bolt locator indicia on the body, the first set of indicia representative of bolt locations arranged in a first bolt pattern;

wherein each of the anchor bolts for use with the template comprises a first nut for engaging the upper surface of the template and a second nut for engaging the lower surface of the template; and a spacer on the lower surface of the body sized and positioned to support the lower surface of the body a distance from the upper edge of the mold, the distance being at least about the width of the second nut.

14. The anchor bolt template of claim 13 wherein the body is formed by a hub and a plurality of arms extending radially from the hub, wherein each arm is generally C-shaped forming a spine with opposing depending edges so that the pair of depending edges form the spacer, and wherein the at least first set of notches are formed in the depending edges.

15. The anchor bolt template of claim 14 wherein the template is adapted for use with a plurality of sizes of molds, each size having a different diameter, wherein the at least a first set of notches comprises a first set and a second set of notches, each set of notches arranged to receive a different one of the plurality of mold sizes, wherein the at least one set of bolt locator indicia comprises a first set and a second set of bolt locator indicia, wherein the second set of bolt locator indicia set corresponds to a second bolt pattern.

16. An anchor bolt template to support a plurality of anchor bolts in at least a first pattern inside a concrete mold, the mold comprising a side wall terminating at an open top having a diameter and defined by an upper edge, the template comprising:

an integrally formed body sized for placement over the open top of the mold, the body having an upper surface and a lower surface, wherein the body is formed by a hub and a plurality of arms extending radially from the hub, wherein each arm is generally C-shaped forming a spine with opposing depending edges;

at least a first set of notches formed on the lower surface of the body, wherein the notches are positioned at circumferentially spaced points corresponding to points on the upper edge of the mold, wherein the at least first set of notches are formed in the depending edges of the arms of the body, and wherein the notches are sized to receive the upper edge of the mold so that when the template is fitted on the open top of the mold and as concrete is poured into the mold, the side walls of the mold resist deformation by the concrete; and at least a first set of bolt locator indicia on the body, the first set of indicia representative of bolt locations arranged in a first bolt pattern.

17. The anchor bolt template of claim 16 wherein the template is adapted for use with a plurality of sizes of molds, each size having a different diameter, wherein the at least a first set of notches comprises a first set and a second set of notches, each set of notches arranged to receive a different one of the plurality of mold sizes, wherein the at least one set of bolt locator indicia comprises a first set and a second set of bolt locator indicia, and wherein the second set of bolt locator indicia set corresponds to a second bolt pattern.

18. An anchor bolt template to support a plurality of anchor bolts in at least a first pattern inside a concrete mold, the mold comprising a side wall terminating at an open top having a diameter and defined by an upper edge, wherein each of the anchor bolts comprises a first nut and a second nut for engaging the template therebetween, the template comprising:

an integrally formed body sized for placement over the open top of the mold, the body having an upper surface and a lower surface, wherein the body is formed by a hub and at least three arms extending radially from the hub;

at least a first set of bolt locator indicia on the upper surface of the body, the first set of indicia representative of bolt locations arranged in a first bolt pattern, whereby, when the anchor bolts are inserted through the template at the bolt locations, the first nut will engage the upper surface of the template and the second nut will engage the lower surface of the template;

a spacer on the lower surface of the body sized and positioned to support the lower surface of the body a distance from the upper edge of the mold, the distance being at least about the width of the second nut.

19. The anchor bolt template of claim 18 wherein the at least three arms comprises four arms.

20. The anchor bolt template of claim 18 wherein the template is adapted for use with a plurality of sizes of molds, each size having a different diameter, wherein the at least one set of bolt locator indicia comprises a first set and a second set of bolt locator indicia, wherein the second set of bolt locator indicia set corresponds to a second bolt pattern.

21. The anchor bolt template of claim 20 wherein the template further comprises size indicia relative to the bolt locator indicia representative of the diameter of the first and second bolt patterns.

22. The anchor bolt template of claim 18 wherein each arm of the template is generally C-shaped forming a spine with opposing depending edges so that the pair of depending edges form the spacer.

23. The anchor bolt template of claim 18 wherein the template further comprises size indicia relative to the bolt locator indicia representative of the diameter of the first bolt pattern.

* * * * *